United States Patent [19]

Pabst et al.

[11] 4,011,623

[45] Mar. 15, 1977

[54] APPARATUS FOR MECHANICALLY REMOVING MOISTURE FROM WEB-FORMED MATERIAL

[75] Inventors: Manfred Pabst, Weiden near Cologne; Kurt van Wersch, Wegberg, both of Germany

[73] Assignee: A. Monforts Maschinenfabrik, Monchen-Gladbach, Germany

[22] Filed: Jan. 21, 1976

[21] Appl. No.: 650,859

[30] Foreign Application Priority Data

Jan. 21, 1975 Germany ..... 2502149
Oct. 25, 1975 Germany ..... 2547917

[52] U.S. Cl. ..... 15/306 A; 68/20
[51] Int. Cl.[2] ..... A47L 5/38
[58] Field of Search ..... 15/303, 306 R, 306 A; 68/20

[56] References Cited

UNITED STATES PATENTS

| | | | |
|---|---|---|---|
| 883,536 | 3/1908 | Gessner | 15/306 A X |
| 1,007,137 | 10/1911 | Palmer | 15/306 A X |
| 2,515,223 | 7/1950 | Hollick | 15/306 A X |
| 2,889,696 | 6/1959 | Lynch | 68/20 |
| 3,394,470 | 7/1968 | Fleissner | 68/20 X |
| 3,574,261 | 4/1971 | Bailey | 15/306 A X |
| 3,592,585 | 7/1971 | Candor et al. | 68/20 X |
| 3,837,188 | 9/1974 | Schuierrer | 68/20 |

*Primary Examiner*—Christopher K. Moore
*Attorney, Agent, or Firm*—Herbert L. Lerner

[57] ABSTRACT

Apparatus for continuously mechanically removing moisture from web-shaped porous material, includes a drum having a cylinder casing formed with holes therein, the drum being subjectible to negative pressure from within the cylinder casing, a cover layer of absorbent material formed with penetrating capillaries and uniformly disposed over the cylinder casing, means for guiding the web-shaped material about a part of the peripheral surface of the cylinder casing and the cover layer disposed thereon, whereby the moisture to be removed from the material is sucked through the holes and carried off with the aid of the negative pressure, an air-impermeable endless entrainer spaced from the cover layer and engageable with the web-shaped material guided about the part of the peripheral surface of the cylinder casing, for pressing the web-shaped material, in cooperation with the negative pressure from within the cylinder casing, against the cylinder casing covered by the cover layer of absorbent material.

14 Claims, 6 Drawing Figures

APPARATUS FOR MECHANICALLY REMOVING MOISTURE FROM WEB-FORMED MATERIAL

The invention relates to apparatus for the continuous, mechanical removal of moisture from porous web-formed material which is guided over part of the periphery of a drum that is exhausted or subjected to suction from the inside thereof, and the cylindrical barrel or casing of which is formed with holes to suck and carry off with the aid of negative pressure, the liquid or moisture that is to be removed. The term "removing moisture" as employed herein includes the driving-off of water or other liquids and mixtures of liquids of all kinds.

Apparatus of this general type is described in German Published Prosecuted Application DT-AS 1 009 150 and is intended for draining off webs of textile fabric that are guided without tension, the water being removed from the textile web by means of a rotatably driven tube serving as carrier and transporter, and which has a perforated casing within which a vacuum is produced. The textile web lies directly on part of the periphery of the perforated casing. To seal off the holes of the casing that are not covered by the textile web, a rotatably supported sealing roller is provided inside the perforated tube and disposed eccentrically to the latter, the sealing roller having a highly elastic and largely deformable surface.

The aforementioned heretofore known apparatus, however, has the following shortcomings among others. Since the web of material rests directly on the perforated cylinder casing, the individual holes must be very fine, so that they do not leave a mark on the web of textile material, and very many holes must be provided, in addition, so that the water is removed uniformly from the web. Even only because of the large number of closely spaced holes in the cylinder casing, and especially because outside air is sucked in through the textile web, it is very costly to produce and maintain a vacuum inside the cylinder. To this is added the fact that the seal between the inner wall of the perforated cylinder and the sealing roller, which is eccentrically and rotatably mounted therein, increasingly deteriorates with the running time that is, with increasing wear of the sealing roller, so that a large part of the vacuum is lost also between the inner wall of the perforated cylinder and the sealing roller.

From German Published Non-Prosecuted Application DT-OS No. 2,039,052, there is further known a drying drum which is heated from the inside, and the perforated barrel or casing of which has a porous, steam-permeable outer layer. Between the porous outer layer and the casing of the drum, there are discharge passages running substantially parallel to the drum axis for the removal of the steam which penetrates inwardly through the porous outer layer. The heretofore known apparatus of the first mentioned German application, is a drying device, in which steam generated by heat is drawn off by suction. In contrast thereto, the invention of the instant application relates to apparatus for the mechanical removal of moisture from textile material in web form without the use of or necessity for applying heat.

It is further known fron German Published Non-Prosecuted Application DT-OS No. 2,039,052, to press the web of material to be dried against the outer surface of the cylinder by means of an air-impermeable steel belt. To produce the compressive force, the steel belt is kept under considerable tension. Nonetheless, appreciable surface pressures (for example 1 kg/cm$^2$) cannot be produced by means of a steel belt kept under longitudinal tension.

In another context, namely, in a continuously operating hot-pressing or shrinking machine, an apparatus for pressing, heating and demoisturizing a web of textile material by means of a perforated cylinder casing, has furthermore become known from German Published Prosecuted Application DT-AS No. 2,148,311, the perforations of the cylinder casing or barrel being connected to a negative pressure plenum to produce a suction draft from the outside to the inside. The web of textile material to be treated travels between the cylinder casing or barrel and an air-impermeable entrainer. The cylinder casing per se is heated from the inside, for example, by means of superheated steam. Here, too, the holes in the cylinder casing obviously serve to remove the steam generated by the heating of the web of textile material and to generate, simultaneously, inside the space between the air-impermeable entrainer and the cylinder casing, a negative pressure such that the entrainer is pressed against the web of textile material with the desired contact pressure. Moisture removal in the sense of the invention of the instant application is not possible per se, because the liquid cannot find its way in sufficient quality to the holes in the cylinder casing within one revolution around the cylinder casing.

Heretofore, to remove moisture from webs of textile materials, besides the aforementioned suction drums, suction bars and, especially, pairs of squeeze rollers or the like, have been used singly or in combination. In the demoisturizing or dewatering process proper, starting with a high moisture content, all of the surface water or moisture of the web of textile material to be dried must be removed, as much as possible and in the final drying step, which is of no interest in the present context, the soaking water is then also driven out of the web of textile material. Thermal contact or convection drying is used throughout. If a web of textile material, to which surface water still adheres, enters a final drying machine, spotting can occur at the guide members of the machine. If the web of textile material had first been dyed, undesired migration of the dye into the zones of the web of textile material, first dried can further occur if surface water is present.

Since mechanical dewatering or demoisturizing offers the most cost-effective solution of the water removal problem because of the low energy costs as compared with all thermal processes, one strives to remove the water from a web of textile material mechanically as far as possible before the web runs into the final drying machine.

In general, pairs of squeeze rollers are presently used for the mechanical removal of water, between which the web of textile material is run. Sufficient water removel i.e., a residual moisture of 50% to 100%, depending upon the type of textile material, can be achieved only with a very high line pressure of, for example, 30 to 50 kp/cm (kilopond per centimeter). If a uniform squeezing effect over the entire width of the web of textile material is important, line pressures of such magnitude can be achieved, but only with expensively constructed squeeze roller arrangements. Also, suction bars have not found acceptance because of the high consumption of expensive compressed air and the enormous noise they generate.

The term "water or moisture removal" includes, as aforementioned, the driving off of liquids and mixtures of liquids of all kinds and, therefore, among other things, also dye solutions and other agents. In dyeing processes common heretofore, the excess dye not absorbed by the textile material must be washed or rinsed out after the solution is applied (by immersion, blocking, brushing or the like). To this end, numerous washing and rinsing baths disposed in tandem, are required. for dyeing 500 kg of textile material in a winch vat, for example, about 7 $m^3$ of dye solution are required with a dye solution ratio of 1:14. If, during substantive dyeing, the dye yield or depletion is only about 50%, then the remaining 50% of dye must be washed or rinsed out again, which requires, as a rule, four rinsing baths i.e., additional 28 $m^3$ of rinsing water, for a rinsing time of about 1½ hours. The situation is even worse for rinsing print cloth.

Heretofore, it has been possible partly to dewater in a washing or rinsing process, substantially flat-running cloth which is insensitive to very high mechanical line pressures, by mechanical means including two roller squeezers. However, the dewatering effect is relatively small in the case of such squeezers, as will be shown in detail hereinbelow with the aid of various examples. There are, furthermore, many kinds of webs of textile materials, from which moisture cannot be removed at all adequately with conventional squeezers. Among these, are all sorts of relief-type knitted goods, fabric webs of textured yarns, especially thick, fluffy or voluminous webs of textile material or the like. Such webs can either not be squeezed at all to the desired measure, or they are damaged considerably in the squeezing by the high line pressure. The same is true for textile webs traveling in the form of rope or hank-like strands or hose, to which conventional mechanical squeezers cannot be applied for demoisturizing when washing or rinsing, because the squeezing process can cause an undesired change in the distribution of the agents on the textile material, and longitudinal creases or folds are thus pressed into the same. In addition, only such low dewatering effects are obtained thereby that the skein is still virtually dripping wet after leaving the squeezer. One advantage of the skein or hank treatment, as compared to full-width treatment, namely, the lower expense for machine width, is therefore set off or annulled by the number of washing or rinsing baths that are additionally required.

It is primarily an object of the invention to provide an apparatus of the initially aforementioned type for mechanically removing moisture by means of which, moisture can be removed from textile material so completely in the course of one revolution thereof about a suction drum, that the material can sbusequently be fed directly to the final dryer. In particular, demoisturizing or dewatering results are to be achieved which cannot be attained with any heretofore conventional continuously operating machines. The demoisturizing or dewatering effects of the apparatus of the instant application should be at least approximately as high as can be obtained with centrifuges (in discontinuous or batch operation). In addition, it is an object of the invention, to provide such an apparatus, in the use of which, energy consumption for demoisturizing or dewatering is reduced. The permissible energy consumption for mechanical demoisturizing or dewatering as measured against the thermal drying processes, requiring the least energy, indicates that, at present, an energy consumption of 70 KW remains tolerable for a machine speed of 40m/min with a fabric width of 2.0m and a fabric weight of 100g/$m^2$. It is therefore also an object of the invention to provide a demoisturizing machine which achieves the desired demoisturizing effects with considerably lower energy consumption than heretofore.

It is also an object of the invention to provide such an apparatus which, after dyeing, printing and other application of agents to the webs of textile materials, will decrease the expenditure for washing and rinsing means, expecially the cost of the required water as well as the treatment time and the energy consumption to drive out excessive agents, and in particular, to reduce the number of washing and rinsing units disposed in tandem.

With the foregoing and other objects in view, there is provided, in accordance with the invention, apparatus for mechanically demoisturizing web-shaped material wherein the web-shaped material from which moisture is to be removed, is guided between a perforated cylinder barrel or casing of a drum that is uniformly covered on the outside thereof with a cover layer of absorbent material penetrated by capillaries, and an air-impermeable, endless entrainer. In accordance with the invention, the web-shaped material from which moisture is to be removed, gives off its moisture to the cover layer and is sucked away by negative pressure prevailing inside the drum.

The air-permeable entrainer, the cover layer and the drum with the perforated cylinder casing, subjected to negative pressure, interact as follows: The negative pressure acting from the interior of the drum and developed through the cover layer and the web-shaped material, ensures uniform compression of the entrainer against the cylinder casing and thereby, of the web-shaped material against the cover layer. Thereby, the surface water (or any other surface liquid) of the web-shaped material, from which the moisture is to be removed, is largely released and is removed from the web-shaped material by capillary attraction due to the different capillary forces of the cover layer and the web-shaped material. At the same time, the negative pressure causes the liquid that has penetrated into the cover layer, to be sucked away (into the drum), in such a manner that the suction or absorption force of the capillaries of the cover layer is continuously maintained. The negative pressure thus has a dual function; on the one hand, it ensures the release of the liquid contained in the web-shaped material by pressing the web-shaped material against the cover layer. On the other hand, by applying suction to the cover layer, the negative pressure prevents the development of equalization or equilibrium of the capillary liquid displacement between the web-shaped material and the cover layer. In the apparatus constructed in accordance with the invention, the liquid or moisture is therefore initially passed from the web of textile material to the cover layer through (intimate) contact between the former and latter, and is then sucked out of the cover layer. The latter thus acts like a blotter which is continuously moisturized on one surface thereof and demoisturized on the other surface thereof.

An absorbent fleece formed essentially of viscose, has proven suitable as the cover layer, in accordance with another feature of the invention. It is advantageous in this connection to place a very thin fleece several times around the cylinder casing (demoisturizng drum). Thereby, the beginning and the end of the fleece do not leave a mark on the web of textile material. It is also advantageous for the fleece or spun fabric, which can be made of very inexpensive material, to be always removable without great difficulty after it is worn out or has become soiled, so that is can be replaced by a new fleece that can be wrapped around the drum. Replacement of the fleece is of interest particularly if moisture is to be removed with the apparatus of the invention from goods coming from a dyeing vat; the fleece is then usually also replaced if the dye is changed. Because of the low cost, the used fleece can be destroyed or otherwise disposed of.

If, however, only water is to be removed with the apparatus according to the invention in continuous operation, for example, relatively pure water is to be drawn off, it is advisable, in accordance with further features of the invention, to make the cover layer of porous ceramic or sintered material having penetrating or through pores.

To provide ready access to the holes in the cylinder casing for the liquid withdrawn from the web of textile material from which the liquid is to be removed, it is advantageous, in accordance with an additional feature of the invention, to provide an annular cylindrical gap between the cover layer and the cylinder casing, formed, for example, by means of a wire screen which completely encloses the cylinder casing. In this gap or space, the vacuum (or negative pressure) can be equilized or attain equilibrium over the entire surface of the cylinder covered by the web of textile material.

From this it is seen that relatively few holes at the surface of the cylinder are sufficient not only to draw the liquid from the material that is to be demoisturized, but also to produce a negative pressure which is uniformly distributed over the entire surface of the cylinder covered by the web of textile material. It is therefore unnecessary to connect the entire interior of the drum or the cylinder to the negative-pressure pump. It is sufficient, rather, in accordance with an added feature of the invention, to connect the holes formed in the cylinder casing, which extend in strips parallel to the drum axis, to the negative-pressure pump through separate lines and a control head. For example, in accordance with the invention, tubes are coordinated or associated, for this purpose, inside the drum, with the rows of holes formed in the cylinder casing, the tubes being airtightly connected to the inside wall of the cylinder casing, the negative-pressure pump being connected thereto through a control head. As the drum revolves, the control head automatically connects to the negative-pressure pump those holes or rows of holes of the cylinder casing that are covered by the web or textile material which is to be demoisturized. The holes of the cylinder casing which are not then covered by the web of textile material, are not connected to the negative-pressure pump, and the pump power is consequently advantageously utilized (note the hereinaforementioned German Published Non-Prosecuted Application DT-OS 2,148,311).

A further important part of the apparatus according to the invention is the air-impermeable endless entrainer or idler formed, for example, of rubber, by means of which, the material from which the moisture is to be removed is pressed against the cylinder casing. Through this entrainer, on the one hand, the underpressure is unable to equalize or effect equlibrium with the outer air through the layer from which the moisture is to be removed and, on the other hand, the entrainer is pressed by the negative pressure against the web of textile material to be demoisturized. Theoretically, with a perfect vacuum, the surface pressure exerted by the entrainer on the web of textile to be demoisturized can thus assume a magnitude of 1 kp/cm$^2$. Such a surface pressure, which could in no way be obtained through longitudinal stressing or tension of the entrainer (somewhat in accordance with the hereinaforementioned German Published Non-Prosecuted Application DT-OS No. 2,039,052), is of advantage, in the apparatus of the invention of the instant application, for aiding the removal of the moisture, but it is not large enough to damage delicate webs of textile material. Because of the low surface pressure that is exerted on the web of textile material, moisture can be removed even from very pressure sensitive or voluminous webs without the slightest damage to these webs.

A further advantage of the invention lies in the use of the apparatus in the washing or rinsing of textiles. The textile web can be guided flat or full width and be demoisturized by means of the apparatus according to the invention to an extent that is not possible with conventional squeezers. In addition, textile webs guided flat or full-width, and which cannot be treated with squeezers, can be demoisturized in accordance with the invention down to very low residual moisture.

Primarily, however, moisture can be removed surprisingly from textile webs or pieces, that are blocked, printed or similarly treated with chemical agents and that are in the form of ropes or hanks, by means of the apparatus according to the invention, during washing or rinsing or between the individual washing or rinsing operations. A considerable advance in the art provided by the invention is that, in spite of rope or hank treatment, excellent moisture removal results are obtained and, furthermore, because of the good moisture removal data, a considerably reduced number of treatment stages, when compared to conventional installations, is required for washing and rinsing, also in the case of rope or hank treatment.

For example, material that cannot be treated with squeezers, shorn cotton plush (Niki), has heretofore been transported, during a dyeing process, dripping-wet from one washing or rinsing bath to the next, until the excess dye was removed from the material to the desired extend. In the mode of operation according to the invention, on the other hand, about 75% of the chemical agents which remain in the material and must be washed out e.g. dye and auxiliary media (assuming a water loading or charging prior to squeezing of 400% and a dewatering value for shorn cotton plush to 100% residual moisture), are removed from the material already in the first water removal operation. In the subsequent rinsing, the major part of the remaining 25% of the excess agents remains in the rinse water. After repeated dewatering in accordance with the invention, again about 75% of the small residue, as compared with rinsing without subsequent dewatering of the agents to be washed out, is removed from the material, so that the latter is frequently sufficiently clean after only two rinses, in contrast to the at least four rinses that have been necessary heretofore.

Further advantages of the apparatus of the invention of the instant application are that energy consumption is extremely small, because when the suction zone is well sealed at the perforated drum, only slight negative pressure losses occur. When changing the treatment liquid or changing the quality of the web of textile material from which the moisture is to be removed, the apparatus according to the invention can be adapted without difficulty to the new demands, and in particular, it is possible, with a few manipulations, to remove the absorbent cover layer of the cylinder casing and replace it with a new cover layer.

In some cases, it has been found to be advantageous, and in accordance with another feature of the invention, not only to cover or line the cylinder casing but also the entrainer with a cover layer of absorbent material (on the side facing the web of textile material), with the result that adhering water cannot collect at the entrainer.

In the following table, the demoisturizing effects attainable with the invention are listed for numerous types of webs of textile material and are compared with the values obtainable with a conventional, continuously operating two-cylinder squeezer, on the one hand, and a centrifuge in batch operation, on the other hand.

Table

| Measured Residual Moisture in % of Dry Weight | | | | |
|---|---|---|---|---|
| No. | Article | Centrifuge | Squeezer | Invention |
| 1 | PES knitted goods | 13 | 93 | 27 |
| 2 | PES texturized knitted goods | 13 | 120 | 24 |
| 3 | PES texturized knitted goods | 14 | 109 | 25 |
| 4 | PES Crimplain knitted goods | 14 | 106 | 23 |
| 5 | PAN Dralon knitted goods | 28 | 115 | 59 |
| 6 | PA knitted goods | 20 | 106 | 23 |
| 7 | PES structured knitted goods | 17 | 111 | 14 |
| 8 | synthetic knitted goods | 15 | 120 | 18 |
| 9 | synthetic knitted goods | 22 | 83 | 40 |
| 10 | PES / Wo 55/45 woven goods | 31 | 58 | 40 |
| 11 | PES / Wo 55/45 woven goods | 29 | 50 | 41 |
| 12 | PES / Co 67/33 woven goods | 36 | 49 | 41 |
| 13 | PES / Sw 67/33 woven goods | 42 | 68 | 52 |
| 14 | dressing matl., knitted goods | 53 | 72 | 82 |
| 15 | Wool knitted goods | 32 | 98 | 52 |
| 16 | Staple fiber, knitted goods | 96 | 119 | 138 |
| 17 | Staple fiber, woven goods | 82 | 40 | 54 |
| 18 | Co. test woven goods | 61 | 84 | 75 |
| 19 | Co. cord | 40 | 93 | 69 |
| 20 | PES / Wo woven goods | 30 | 59 | 38 |
| 21 | PES / Wo woven goods | 28 | 68 | 38 |

In column 1 of the Table consecutive members of the measurements are provided; in column 2 the type of material from which the moisture is to be removed; in column 3, the moisture removal achieved with a laboratory centrifuge after an operating time of about 2 minutes; in column 4, the moisture-removal values obtained with a two-cylinder squeezer with a line pressure of $P_L \approx 30$ kp/cm and 23 m/min of the running speed of the material; and in column 6, the demoisturizing values (as so-called residual moisture in percentage of the dry weight) obtained in accordance with the invention by means of a negative-pressure drum, fleece cover layer and silicon-lined wool felt cover belt with a surface negative pressure of $P_U = 0.8$ kp/cm$^2$ with similarly 23 m/min speed of the material.

The abbreviations in the Table have the following meaning: PES = polyester, PAN = polyacrylic nitrile, PA = polyamide, Wo = wool, Co = cotton, Sw = staple wool fiber; PES/Wo 55/45 = 55% PES + 45% Wo.

It is apparent from the Table, the residual moisture figures attainable with the invention are almost all far below those which can be obtained with a two-roller squeezer. There are only three exceptions in the Table, namely, Nos. 14, 16 and 17. In these cases, it should be taken into consideration that the demoisturized material has by nature such fine capillaries that, with the cover layer used in the test, the capillary working mechanism between the cover layer and the web of textile material could not take place. There is no doubt that, also in the three aforementioned cases, better results can be obtained with the apparatus according to the invention than with a squeezer, if suitable cover layers with fine capillaries are used. It is found that the apparatus according to the invention of this application is far superior to the two-cylinder squeezing devices generally used heretofore for the continuous removal of water and almost reaches the moisture-removal values attainable with the centrifuge.

Other features which are considered as characteristic for the invention are set forth in the appended claims.

Although the invention is illustrated and described herein as embodied in apparatus for mechanically removing moisture from web-formed material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
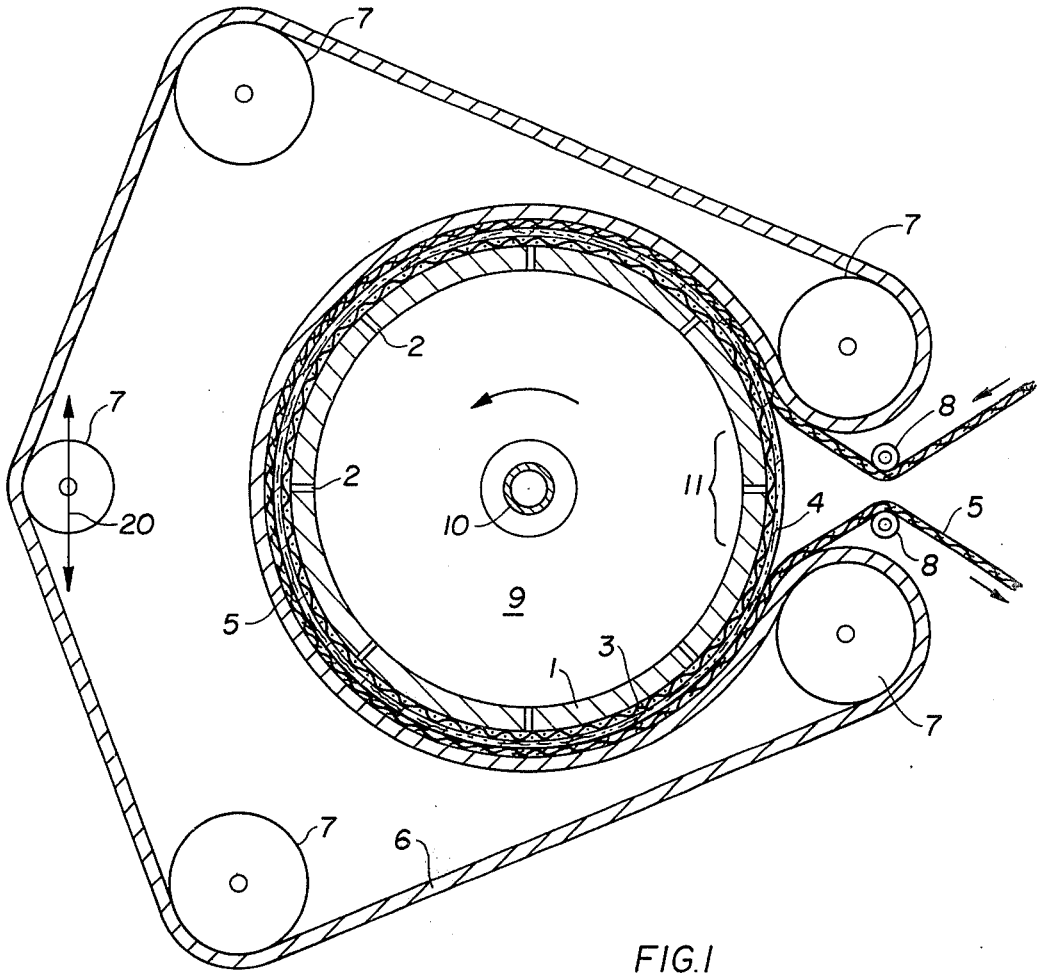
FIG. 1 is a cross-sectional view perpendicular to the longitudinal axis of the cylinder trommel or drum of an apparatus for mechanically removing water from web-formed material in accordance with the invention.

Referring now to the drawing and first, particularly to FIG. 1 thereof, there is diagrammatically shown a water or liquid removal apparatus according to the invention with a cylinder drum or trommel 1, in the barrel or casing of which, holes 2 are formed. A wire screen 3 is disposed around the cylinder drum 1 and is, in turn, surrounded, over the entire surface of the cylinder casing, by an absorbent cover layer 4. A web 5 of textile material, from which water is to be removed, is guided over the cover layer 4 and is pressed against the barrel or casing of the cylinder 1 by means of an air-impermeable, endless entrainer belt 6. The entrainer 6 is guided over rollers 7. In general, the entrainer 6 has no drive of its own but is entrained through friction by the cylinder 1, which is driven about a hollow shaft 10 in direction of the curved arrow associated therewith in FIG. 1. The web 5 of textile material is introduced into and leaves the gap between the entrainer 6 and the cover layer 4 over rollers 8, respectively, in direction of the arrows shown at the right-hand side of FIG. 1.

The compressive force of the entrainer 6 is not caused by a longitudinal stress exerted thereon, but rather by underpressure or negative pressure which is produced and maintained in the interior space 9 of the cylinder 1, for example, with the aid of a non-illustrated negative pressure pump connected to the hollow shaft 10. The negative pressure acts through the holes 2 formed in the cylinder barrel or casing and sucks the entrainer belt 6 against the cylinder 1, whereby the web 5 of textile material is compressed and dewatered due to the capillary attraction of the cover layer 4.

Since the dewatering action of the suction does not (directly) act upon the web 5 of textile material, but rather, upon the cover layer 4, the web 5 of textile material is dewatered uniformly due to capillary attraction even with relatively few holes 2 formed in the cylinder casing. The aspiration or sucking of the liquid out of the cover layer 4 as well as the uniform spread of the negative pressure between the cylinder 1 and the entrainer 6 is facilitated if the wire screen 3 is placed between the cover layer 4 and the cylinder 1.

In the embodiment of the apparatus of the invention shown in FIG. 1, no special means need be provided generally to close off that zone 11 of the inner wall surface of the cylinder 1 which, during rotation, is not covered on the outside by the entrainer 6, in order to prevent pressure equalization with the ambient environment through the zone 11 or the holes 2 of the cylinder casing that are located in the zone 11. Because of the relatively small number of the holes, only relatively little outside air will be drawn-in the traveling or shifting zone 11; however, this air flows through the cover layer 4 and contributes to the dewatering thereof.

If no covering is provided in the zone 11, as in the embodiment of FIG. 1, the power rating of the non-illustrated negative pressure pump must be increased somewhat; but the otherwise necessary, stationary covering mechanism within the rotary cylinder casing is dispensed with.

Figure 2:
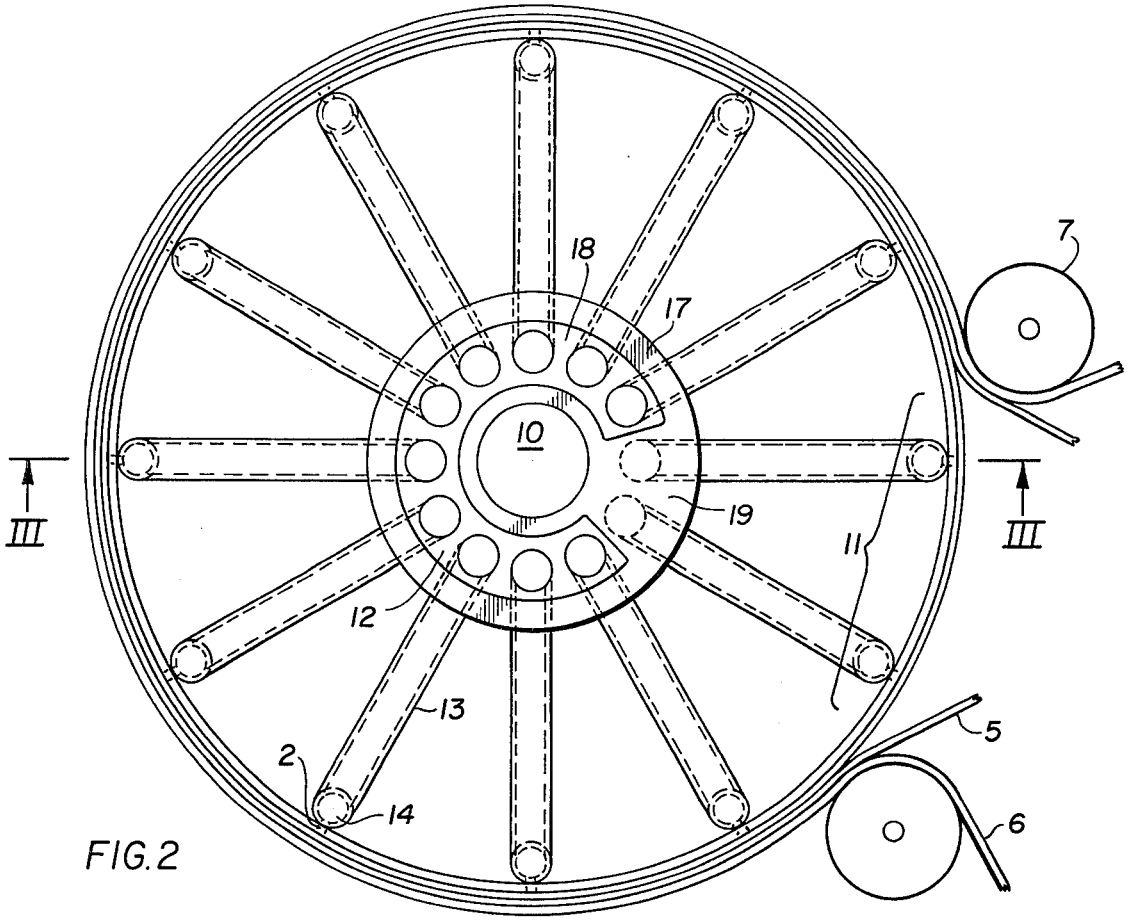
FIG. 2 is a view similar to that of FIG. 1 of another embodiment of the cylinder drum thereof.
Figure 3:
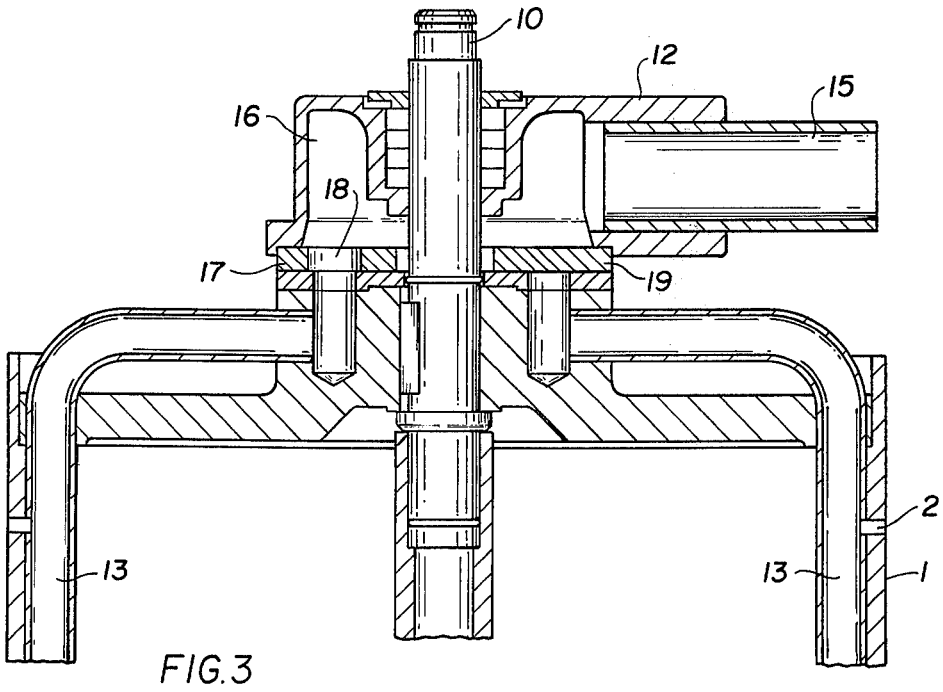
FIG. 3 is a cross-sectional view of FIG. 2 taken along the line III-III in the direction of the arrows and showing a control head which forms part of the invention.
Figure 6:
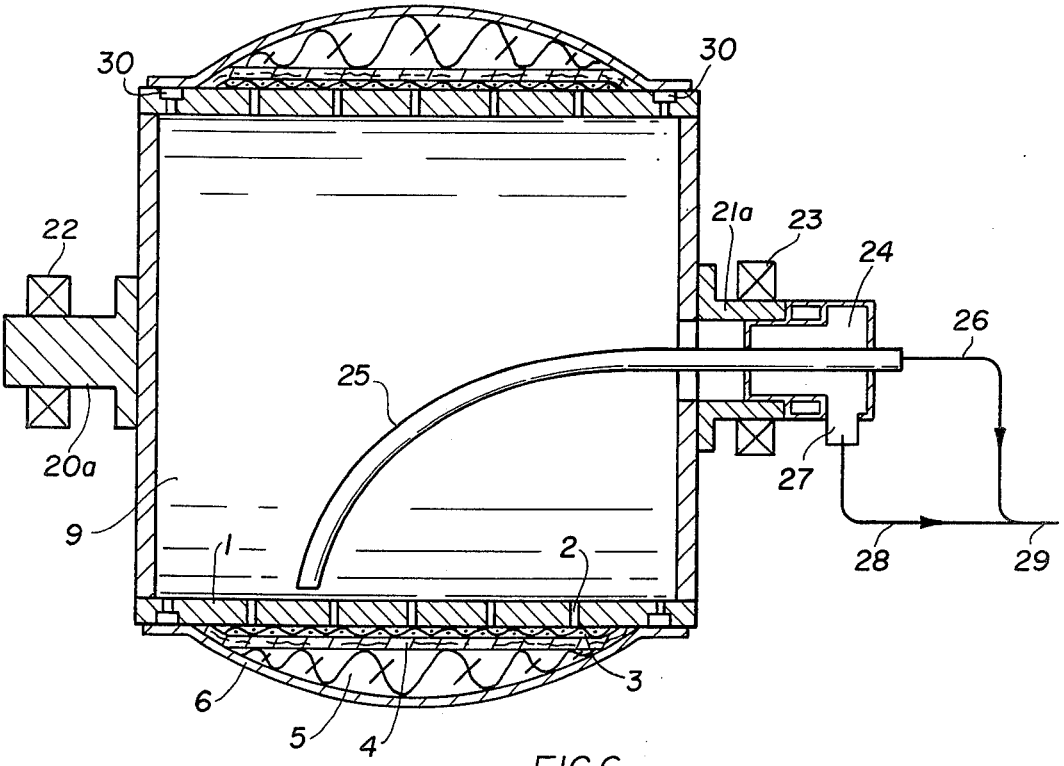
FIG. 6 is a longitudinal sectional view of a cylinder drum with rope or hank disposed thereon.

If the pressure loss over the zone 11 of FIG. 1 becomes too large in individual cases, however, then one can advantageously use a control head arrangement as in the embodiments of FIGS. 2 and 3 or FIG. 6, instead of the heretofore conventional airtight covers, such as are described, for example, in German Published Prosecuted Application DT-AS No. 1,009,150.

In FIGS. 2 and 3, the non-illustrated negative-pressure pump is connected to the control head 12 which connects the source of the negative pressure through connecting tubes 13 and distributor tubes 14 with the holes 2 (except in the zone 11). The control head 12 per se is shown enlarged in FIG. 3, which is a cross-sectional view of FIG. 2 taken along the line III—III. The control head 12 is formed of an air (and liquid) outlet 15, to which there is connected a distributor chamber 16 disposed annularly around the shaft 10. The distributor chamber 16, which is immovable during the operation of the apparatus, is disposed with a similarly stationary control disk 17 against the part of the control head 12 or the cylinder 1 which rotates during the operation of the apparatus.

The control disk 17 (FIG. 2) is provided with a cut-out or recess 18 in the form of an incomplete or non-closed ring. At hose locations of the control disk 17, at which the recess ring 18 is interrupted, the source of the negative pressure is not connected to the connecting lines 13 which are, in fact, sliding past this location. These closed regions 19 of the control disk 17 are associated or coordinated with the zone 11 which travels or shifts as the cylinder 1 rotates. In the embodiment illustrated in FIG. 2, two of the connecting lines 13 and, therewith, the corresponding holes 2 of the cylinder casing, are obviously always not connected to the negative pressure source. However, the negative pressure can act through the ring-shaped cut-out 18 on the other connecting lines 13 and their corresponding holes 2 formed in the cylinder wall or casing.

Although no longitudinal stress is exerted on the entrainer belt 6, it may be advisable, nevertheless, to equip at least one of the rollers 7, which guides the entrainer 6, with tightening means, for example, to compensate for any elongation that may have occurred during operation of the apparatus. In FIG. 1, such a tightener roll (control cylinder) 20 is shown. After the web 5 of textile material that is to be dewatered has run through the apparatus constructed in accordance with the invention, it can either be fed to a succeeding machine, such as a final dryer, for example, or deposited in folds or rolled up.

Figure 4:
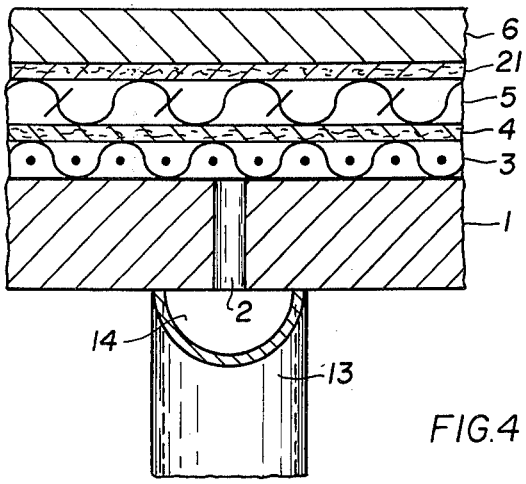
FIGS. 4 and 5 are enlarged cross-sectional views, respectively, perpendicular and parallel to the axis of the cylinder drum and showing the individual layers of the cylinder drum.
Figure 5:
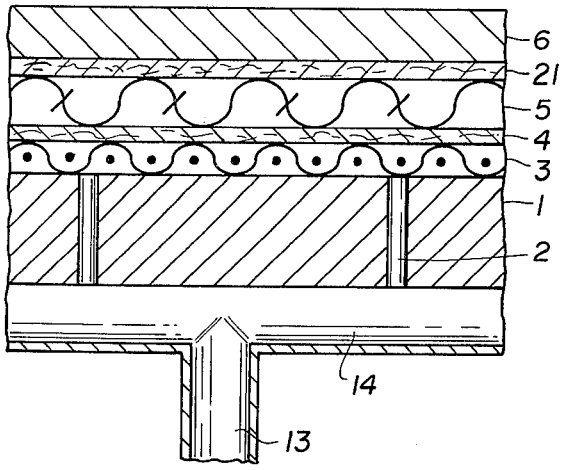

In FIG. 4, the individual layers at the surface of the dewatering cylinder 1 according to FIGS. 1 or 2 are shown in detail on a larger scale than in the latter figures. From the outside inwardly the entrainer 6 and an absorbent cover layer 21, that is advantageous in some instances; the web 5 of textile material that is to be dewatered; the absorbent cover layer 4 which is essential to the functioning of the apparatus according to the invention; the wire screen 3 and the cylinder casing or wall 1, follow one another in succession. In the cylinder wall 1, a hole 2 is formed, which can be connected, if need be, with the control head 12 through the distributor tube 14 which connects several of such holes 2, and through the connecting tube 13. FIG. 5 is a longitudinal sectional view of FIG. 4 and, in fact, a sectional view taken through the cylinder barrel or casing parallel to the longitudinal axis of the latter.

The cylinder 1 according to the embodiment of FIG. 6 is of hollow construction and is supported on trunnions 20*a* and 21*a* in bearings 22 and 23. On the trunnion 21*a*, which is hollow, a rotary inlet 24 is disposed, through which chiefly water or liquid to be removed is drawn off by suction through the tube 25 in the direction of the arrow 26, air being sucked away through a connection 27 of the rotary inlet in the direction of the arrow 28. A discharge line 29 (the air and the liquid lines 27 and 25, respectively, are brought together thereat) is connected to a non-illustrated vacuum pump.

It is particularly advantageous for effecting a smooth and sealing contact of the edges of the entrainer belt 6 at the edge of the cylinder barrel or casing 1, to provide at the edges of the latter, substantially circular circumferentially interruped grooves 30 that are likewise connected to the negative pressure space. The edges of the air-impermeable entrainer 6 are subjected to suction by the grooves 30, so that an excellent edge seal for the negative-pressure space formed between the entrainer 6 and the cylinder barrel or casing 1 results.

This edge seal, the construction, function and operation of which is described in detail in German Published Non- Prosecuted Application DT-OS No. 2,542,659 for a machine of a different type, is particularly advantageous in this use of the apparatus for dewatering rope or hank-shaped textile webs or pieces in accordance with the invention of the instant application. It is thereby of decisive importance that such an elastic and soft, air-impermeable entrainer is used that it can spread out during operation of the apparatus i.e., when vacuum is applied to the inner space 9 of the cylinder 1, over the web 5 of textile material and over the cylinder barrel or casing 1 and the edges thereof. The entrainer 6 should, in particular, be constructed so that it is lined up flush with the edge of the surface of the cylinder barrel or casing 1, whereby, if possible, no air can penetrate into the space between the entrainer 6 and the cylinder barrel or casing 1 through the gap between the edge of the cylinder barrel or casing 1 and the entrainer 6. For this reason, it is advantageous to select the width of the cover layer 4 and of the wire screen 3, disregarding the special edge seal, to be somewhat smaller than the width of the cylinder, so that the entrainer 6 can rest directly on the edge of the cylinder barrel or casing or the groove 30 provided therein.

There are claimed:

1. Apparatus for continuously mechanically removing moisture from web-shaped porous material, comprising a drum having a cylinder casing formed with holes therein, said drum being subjectible to negative pressure from within said cylinder casing, a cover layer of absorbent material formed with penetrating capillaries and uniformly disposed over said cylinder casing, means for guiding the web-shaped material about a art of the peripheral part of said cylinder casing and said cover layer disposed thereon, whereby the moisture to be removed from the material is sucked through said capillaries and said holes and carried off with the aid of said negative pressure, an air-impermeable endless entrainer spaced from said cover layer and engageable with the web-shaped material guided about said part of said peripheral surface of said cylinder casing, for pressing the web-shaped material, in cooperation with said negative pressure from within said cylinder casing, against said cylinder casing covered by said cover layer of absorbent material.

2. Apparatus according to claim 1 wherein said cover layer has a finer capillarity than the capillarity of the material from which moisture is to be removed.

3. Apparatus according to claim 1 wherein said cover layer is formed of absorbent fleece.

4. Apparatus according to claim 3 wherein said absorbent fleece consists essentially of viscose.

5. Apparatus according to claim 4 wherein said absorbent fleece consists of substantially 80% viscose and the remainder of polyamide and acrylic fibers.

6. Apparatus according to claim 1 wherein said cover layer is formed of four to five layers of an absorbent fleece.

7. Apparatus according to claim 1 wherein said cover layer is formed of ceramic with penetrating pores.

8. Apparatus according to claim 1 wherein said cover layer is formed of sinter material with penetrating pores.

9. Apparatus according to claim 1 wherein said cover layer and said cylinder casing define therebetween an annular space extending over the peripheral surface of said cylinder casing wherein said negative pressure from within said cylinder casing equalizes over a part of said cylinder casing covered by said entrainer.

10. Apparatus according to claim 9 wherein said annular space is formed by a wire screen received between said cylinder casing and said cover layer.

11. Apparatus according to claim 1 wherein said entrainer, at the surface thereof facing toward the material to be demoisturized, is covered with absorbent material.

12. Apparatus according to claim 1 including means for shifting the negative pressure to the holes in said cylinder casing that are respectively covered by said entrainer.

13. Apparatus according to claim 12 wherein said holes in said cylinder casing are disposed respectively in strips extending parallel to the axis of said cylinder casing, and are connected through separate lines and a control head to a source of said negative pressure, said control head being automatically actuatable during rotation of said cylinder casing to connect to said negative-pressure source respective strips of said cylinder casing that are covered by said entrainer.

14. Apparatus according to claim 13 wherein said source of negative pressure provides a negative pressure of substantially 100 mm Hg absolute.

* * * * *